US007038668B2

(12) United States Patent
Kota et al.

(10) Patent No.: US 7,038,668 B2
(45) Date of Patent: May 2, 2006

(54) PICTURE DISPLAYING APPARATUS, WHICH DOES NOT REQUIRE A CALCULATING CIRCUIT, WHEN THE SCREEN SAVER FUNCTION IS ATTAINED, AND A METHOD OF DRIVING THE SAME

(75) Inventors: Atsushi Kota, Tokyo (JP); Shingo Kawashima, Tokyo (JP); Eitaro Nishigaki, Tokyo (JP)

(73) Assignee: NEC Corporation, Tokyo (JP)

( * ) Notice: Subject to any disclaimer, the term of this patent is extended or adjusted under 35 U.S.C. 154(b) by 261 days.

(21) Appl. No.: 09/977,194

(22) Filed: Oct. 16, 2001

(65) Prior Publication Data

US 2002/0044143 A1 Apr. 18, 2002

(30) Foreign Application Priority Data

Oct. 16, 2000 (JP) ..... 2000/315777

(51) Int. Cl.
*G09G 5/00* (2006.01)

(52) U.S. Cl. ..... 345/204; 345/656; 345/658

(58) Field of Classification Search ..... 345/83, 345/75.2, 76, 598, 851, 418, 531, 543, 100, 345/520, 538, 658, 656; 315/169.3; 348/377, 348/750; 709/200, 247; 386/121
See application file for complete search history.

(56) References Cited

U.S. PATENT DOCUMENTS 5,162,784 A * 11/1992 Guttag et al. ..... 345/440
5,347,292 A * 9/1994 Ge et al. ..... 345/75.2
5,517,609 A * 5/1996 Guillemaud et al. ..... 345/531
5,526,025 A * 6/1996 Selwan et al. ..... 345/556
5,671,440 A * 9/1997 Curry ..... 345/656
5,734,788 A * 3/1998 Nonomura et al. ..... 386/126
5,903,707 A * 5/1999 Sato et al. ..... 386/121
5,920,361 A * 7/1999 Gibeau et al. ..... 348/750
5,925,097 A * 7/1999 Gopinath et al. ..... 709/200
5,977,977 A * 11/1999 Kajiya et al. ..... 345/418
5,995,120 A * 11/1999 Dye ..... 345/543
6,043,818 A * 3/2000 Nakano et al. ..... 345/851
6,072,457 A * 6/2000 Hashimoto et al. ..... 345/100
6,208,325 B1 * 3/2001 Reddy et al. ..... 345/658
6,217,234 B1 * 4/2001 Dewar et al. ..... 709/247
6,313,844 B1 * 11/2001 Yamashita ..... 345/531

(Continued)

FOREIGN PATENT DOCUMENTS

JP 61-264876 11/1986

(Continued)

*Primary Examiner*—Vijay Shankar
*Assistant Examiner*—Prabodh Dharia
(74) *Attorney, Agent, or Firm*—Sughrue Mion, PLLC

(57) ABSTRACT

A picture displaying apparatus that includes scanning lines to which scanning signals are inputted, data lines to which data signals are inputted, and a light emission element present at every intersection of scanning lines and data lines. The designated picture displaying device also consists of a display unit composed of light emission elements and a memory unit containing memory cells that store single units of display data. The units of display data are read from the memory unit in different orders and then written to the picture displaying unit such that the picture or content is different for each predetermined frame or frames. A plurality of display data corresponding to different display contents is generated without a calculating circuit when the screen saver function is activated.

20 Claims, 11 Drawing Sheets

ZIGZAG3

U.S. PATENT DOCUMENTS

| | | | | |
|---|---|---|---|---|
| 6,313,878 | B1 * | 11/2001 | Jankowiak | 348/377 |
| 6,323,871 | B1 * | 11/2001 | Fujiyoshi et al. | 345/598 |
| 6,380,689 | B1 * | 4/2002 | Okuda | 315/169.3 |
| 6,407,740 | B1 * | 6/2002 | Chan | 345/503 |
| 6,545,651 | B1 * | 4/2003 | Nishigaki et al. | 345/76 |
| 6,559,850 | B1 * | 5/2003 | Strongin et al. | 345/520 |
| 6,636,220 | B1 * | 10/2003 | Szeliski et al. | 345/475 |
| 2002/0135585 | A1 * | 9/2002 | Dye et al. | 345/531 |
| 2002/0145610 | A1 * | 10/2002 | Barilovits et al. | 345/538 |

FOREIGN PATENT DOCUMENTS

| | | | | |
|---|---|---|---|---|
| JP | 363203070 | * | 8/1988 | |
| JP | 4-22990 | A | 1/1992 | |
| JP | 08-254964 | | 10/1996 | |
| JP | 09-232074 | * | 5/1997 | 315/169.3 |
| JP | 10-178527 | A | 6/1998 | |
| JP | 2000-105573 | | 4/2000 | |
| JP | 2000-112435 | | 4/2000 | |

* cited by examiner

THE START POSITION IN RAM MOVES OR SHIFT(0→1→2→3→4→5)

ORIGINAL DISPLAY

ZIGZAG1

ZIGZAG2

ZIGZAG3

ZIGZAG4

ZIGZAG5

PICTURE DISPLAYING APPARATUS, WHICH DOES NOT REQUIRE A CALCULATING CIRCUIT, WHEN THE SCREEN SAVER FUNCTION IS ATTAINED, AND A METHOD OF DRIVING THE SAME

BACKGROUND OF THE INVENTION

1. Field of the Invention

The present invention relates to a picture displaying apparatus and a method of driving the same. More particularly, the present invention relates to a picture displaying apparatus that does not require an operational circuit for generating a plurality of display data corresponding to different display contents from a single display data when a screen saver function is attained, and a method of driving the same.

2. Description of the Related Art

In recent years, a demand for a display has been remarkably enlarged. In particular, an expectation for a flat panel display represented by a liquid crystal displaying apparatus (LCD), a plasma displaying apparatus (PD) and the like has been increased.

In particular, a self-light-emission type of a picture displaying apparatus, such as an electro-luminescence (EL) and the like, is characterized in that it has a high visual property and an excellent field angle. Also, it has a merit that a back light is unnecessary, differently from the LCD. Moreover, a picture displaying apparatus using an organic electro-luminescence (EL) element is noticeable as a flat display that is also excellent in response performance.

As a method of driving a dot matrix display using such an organic EL element, there are a simple matrix type and an active matrix type.

FIG. 1 is a block diagram showing a conventional simple matrix type of a color organic EL display. This color organic EL display 100 is provided with: a color organic EL display panel 101 of a QVGA class using an NTSC signal; a column driving circuit 102 for sending a signal current to make the color organic EL display panel 101 emit a light at a desirable brightness; a low driving circuit 103 for sending a predetermined voltage while shifting a low electrode in order to perform a Duty drive on the color organic EL display panel 101; and a controller 104 for generating a control signal to control the column driving circuit 102 and the low driving circuit 103.

In the organic EL pixel, if a light is emitted continuously for a long time at the same display condition, a so-called burning is brought about to thereby increase a deterioration in a brightness caused by an element life. For example, in a case of a color organic EL display panel 101 of a portable telephone apparatus, if a clock, a antenna mark, a remaining amount of a battery and the like are always displayed, the deterioration in the brightness of the organic EL pixel corresponding to that portion is especially increased. Thus, if the color organic EL display panel 101 is used in a display such as a portable telephone apparatus, a computer, a car navigation system or the like, it is designed so as to actuate a screen saver function when a wait image plane is displayed or when there is no change in a screen display content for a predetermined period.

In the screen saver state, an display data of a different display content is sent to the color organic EL display panel 101 so that the same display content is not continuously displayed on the color organic EL display panel 101 beyond the predetermined period.

Conventionally, when the display image plane for the screen saver is prepared, the supply of the display data to the color organic EL display panel 101 is carried out as follows.

A first display data corresponding to an display content of one image plane of the color organic EL display panel 101 is stored in advance in ROM (not shown) of the color organic EL display 100. As mentioned above, in the screen saver state, it requires the display data of the different display content. So, conventionally, after the first display data is read from the ROM to RAM (not shown), the controller 104 performs a calculation on the first display data, and generates a second display data as the calculated result. The second display data is generated so as to indicate a different display content for each set time. In the screen saver period, a plurality of second display data are generated which correspond to a plurality of kinds of display contents.

That is, the single first display data is changed by the calculation for each set time. Thus, the second display data of the different display content is generated for each change, and the second display data is sent to the column driving circuit 102. Hence, the different display is displayed on the color organic EL display panel 101 for each set time. Accordingly, the screen saver function is attained.

According to this method, a circuit for calculating the first display data and then generating the second display data is necessary within the controller 104.

Also, apart from the above-mentioned problem, there is a problem that the characteristic difference between the light emitting elements causes a color balance to be deteriorated. That is, in organic EL pixels corresponding to respective three colors of R, G and B, the lives of the elements are different from each other. Thus, even if the screen saver function is uniformly actuated, the development situation of the brightness deterioration is different depending on the color of the light emission. Hence, this causes the color balance to be deteriorated.

When the screen saver function is attained, the picture displaying apparatus, which does not require the above-mentioned calculating circuit, and the method of driving the same are desired.

When the screen saver function is attained, the picture displaying apparatus, which can suppress the above-mentioned deterioration in the color balance to a minimum, and the method of driving the same are desired.

When the screen saver function is attained, the picture displaying apparatus, which does not require the above-mentioned calculating circuit and can suppress the above-mentioned deterioration in the color balance to a minimum, and the method of driving the same are desired.

When the screen saver function is attained, the picture displaying apparatus, which can attain the lower consumptive electric power and does not require the above-mentioned calculating circuit and can suppress the above-mentioned deterioration in the color balance to a minimum, and the method of driving the same are desired.

By the way, Japanese Laid Open Patent Application (JP-A-2000-112435) discloses the following display driving method. In a method of driving a matrix type of a displaying apparatus having a function of setting a part of a region inside a image plane at a display state and setting the other region at a non-display state, at least one of a position of the part of the region set at the display state, an area and an display content is changed at any temporal interval. Accordingly, while a low consumptive electric power property of a partial display is kept, amusingness and originality are given to the image plane at the partial display state.

Also, Japanese Laid Open Patent Application (JP-A-2000-105573) discloses the following displaying apparatus. At a wait state when a power supply is at an on-state and an interrupt signal is not generated, a control is carried out such that a dot displaying unit of an organic EL display is not turned on and only essentially necessary data is displayed for a character displaying unit. Then, if the interrupt signal is generated, the display corresponding to the data input from a key board or an input/output circuit is displayed only for a predetermined display period. Accordingly, the lower consumptive electric power of the displaying apparatus is attained without any loss of convenience.

Moreover, Japanese Laid Open Patent Application (JP-A-Heisei, 8-254964) discloses the following electrical field radiation color displaying apparatus. The electrical field radiation color displaying apparatus including a frame memory for storing a picture data formatted for a frame sequence display is provided with: a unit for switching the display between a usual electric power consumption mode and a reduced electric power consumption mode; a unit for providing a single color display if the display is at the reduced electric power consumption mode; and a unit for bypassing the frame memory if the single color display is provided. Also, Japanese Laid Open Patent Application (JP-A-Heisei, 8-254964) discloses the following content. An electrical field radiation color display electronic system includes a unit for reducing an electric power. The displaying system includes a voltage switching type of a three-color anode plate and an emitter plate by which an address in a form of matrix can be specified. In the reduced electric power consumption mode, the display is switched from a color mode to a single color mode. By using the unit for reducing the electric power, a bright information for green (carrying a single color picture information) bypasses the frame memory, and it is directly coupled to a second multiplexer through a three-state buffer from a first multiplexer. The buffer carries out an insulation separation of a bypass line at a time of a color operation of the display. In the frame memory, it can be bypassed at the time of the single color operation. Thus, since the frame memory can be set at a wait mode, an electric power of about 1 W can be reduced.

Japanese Laid Open Patent Application (JP-A-Showa, 61-264876) discloses the following picture displaying apparatus. This is provided with: a screen on which a fluorescent material emitting a light when an electronic beam is radiated is coated; an electronic beam source for generating the electronic beam for each vertical block after an image plane on the screen is divided into a plurality of blocks in a vertical direction; a separating unit for separating the electronic beam generated by the electronic beam source for each horizontal block after the electronic beam is divided into a plurality of horizontal blocks; a polarization electrode for polarizing the electronic beam at a plurality of stages in a vertical direction and a horizontal direction between the electronic beam source and the screen; a beam flow control electrode for controlling an amount at which the electronic beam separated for each horizontal block is radiated to the screen and controlling a light emission amount of each pixel on the image plane of the screen; a focusing electrode for controlling the light emission size on the surface of the fluorescent material through the electronic beam in each pixel; a rear electrode for controlling the amount of the electronic beams from the electronic beam source; and an acceleration electrode for accelerating the electronic beam and radiating it to the screen. Also, this is provided with a unit for dividing the beam flow control electrode into the upper portion and the lower portion in the vertical direction at a location corresponding to a position at which the number of horizontally scanning lines is divided into two components and applying the signals, which are deviated by ½ fields, to the respective upper and lower beam flow control electrodes, in the line order corresponding to a horizontal synchronization.

SUMMARY OF THE INVENTION

The present invention is accomplished in view of the above mentioned problems. Therefore, an object of the present invention is to provide a picture displaying apparatus, which does not require the above-mentioned calculating circuit, when the screen saver function is attained, and a method of driving the same.

Another object of the present invention is to provide a picture displaying apparatus, which can suppress the above-mentioned deterioration in the color balance to a minimum, when the screen saver function is attained, and a method of driving the same.

Still another object of the present invention is to provide a picture displaying apparatus, which does not require the above-mentioned calculating circuit and can suppress the above-mentioned deterioration in the color balance to a minimum, when the screen saver function is attained, and the method of driving the same.

Still another object of the present invention is to provide a picture displaying apparatus, which can attain the lower consumptive electric power and does not require the above-mentioned calculating circuit and can suppress the above-mentioned deterioration in the color balance to a minimum, when the screen saver function is attained, and a method of driving the same.

In order to achieve an aspect of the present invention, a picture displaying apparatus, includes: a plurality of scanning lines to which scanning signals are inputted, respectively; a plurality of data lines to which data signals are inputted, respectively; a light emission element disposed at each of a plurality of intersections composed of the plurality of scanning lines and the plurality of data lines; a picture displaying unit having the plurality of light emission elements; and a memory unit storing a single display data indicative of an display content of the picture displaying unit, and wherein the memory unit has a plurality of memory cells, and wherein each of the plurality of memory cells stores a unit display data of a part of the single display data, and wherein a plurality of the unit display data stored in the plurality of memory cells are read from the memory unit in a different order for each single predetermined frame or each plural predetermined frames, and wherein the plurality of unit display data are written to the picture displaying unit in an order when the plurality of unit display data are read from the memory unit, such that the display content in the picture displaying unit is different for the each predetermined frame or frames.

In this case, when the plurality of unit display data are read from the memory unit, at least one specific memory cell among the plurality of memory cells is used as a read start position and the plurality of unit display data are read in accordance with an arrangement order of the plurality of memory cells from the specific memory cell, and wherein the specific memory cell is changed for the each predetermined frame or frames.

Also in this case, a part of the plurality of unit display data is changed before the part of the plurality of unit display data is read from the memory unit, and wherein the plurality of unit display data including the changed part of the plurality of unit display data are read from the memory unit in the different order for the each predetermined frame or frames, and wherein the plurality of unit display data including the changed part of the plurality of unit display data are written to the picture displaying unit, in accordance with the order when the plurality of unit display data are read from the memory unit.

Further in this case, a part of the plurality of unit display data is changed before the part of the plurality of unit display data is read from the memory unit, and wherein the plurality of unit display data including the changed part of the plurality of unit display data are read from the memory unit in the different order for the each predetermined frame or frames, and wherein the plurality of unit display data including the changed part of the plurality of unit display data are written to the picture displaying unit, in accordance with the order when the plurality of unit display data are read from the memory unit.

In order to achieve another aspect of the present invention, a picture displaying apparatus, includes: a plurality of scanning lines to which scanning signals are inputted, respectively; a plurality of data lines to which data signals are inputted, respectively; a light emission element disposed at each of a plurality of intersections composed of the plurality of scanning lines and the plurality of data lines; a picture displaying unit having the plurality of light emission elements; and a memory unit storing a single display data indicative of an display content of the picture displaying unit, and wherein the memory unit has a plurality of memory cells, and wherein the picture displaying unit has a plurality of pixels corresponding to the plurality of light emission elements, and wherein each of the plurality of memory cells stores a unit display data of a part of the single display data, and wherein the unit display data is written to each of the plurality of pixels, and wherein a plurality of the unit display data read from the plurality of memory cells are written to the picture displaying unit in a different order for each predetermined frame or each plural predetermined frames, such that the display content in the picture displaying unit is different for the each predetermined frame or frames.

In this case, when the plurality of unit display data are written to the picture displaying unit, at least one specific pixel among the plurality of pixels is used as a write start position and the plurality of unit display data are written in accordance with an arrangement order of the plurality of pixels from the specific pixel, and wherein the specific pixel is changed for the each predetermined frame or frames.

Also in this case, a part of the plurality of unit display data is changed before the part of the plurality of unit display data is read from the memory unit, and wherein the plurality of unit display data including the changed part of the plurality of unit display data are written to the picture displaying unit in the different order for the each predetermined frame or frames.

Further in this case, a part of the plurality of unit display data is changed before the part of the plurality of unit display data is read from the memory unit, and wherein the plurality of unit display data including the changed part of the plurality of unit display data are written to the picture displaying unit in the different order for the each predetermined frame or frames.

In this case, the picture displaying unit is designed such that lights of the picture displaying unit can be emitted in three colors of R, G and B, and wherein a supply of currents to the plurality of data lines corresponding to at least one of the three colors of R, G and B is stopped, such that the lights are emitted from the picture displaying unit in one or two colors among the three colors of R, G and B.

Also in this case, the picture displaying unit is designed such that lights of the picture displaying unit can be emitted in three colors of R, G and B, and wherein a supply of currents to the plurality of data lines corresponding to at least one of the three colors of R, G and B is stopped, such that the lights are emitted from the picture displaying unit in one or two colors among the three colors of R, G and B.

Further in this case, the at least one of the three colors of R, G and B is changed for the each predetermined frame or frames.

In this case, the at least one of the three colors of R, G and B is changed for the each predetermined frame or frames.

Also in this case, the single display data is one of static picture data and dynamic picture data.

Further in this case, the single display data is one of static picture data and dynamic picture data.

In this case, the light emission element is one of an EL element, a light emitting diode and an FED.

Also in this case, the light emission element is one of an EL element, a light emitting diode and an FED.

In order to achieve still another aspect of the present invention, a method of driving a picture displaying apparatus, includes: (a) providing a picture displaying apparatus which includes a picture displaying unit having a plurality of light emission elements, the plurality of light emission elements being disposed at a plurality of intersections composed of a plurality of scanning lines to which scanning signals are inputted, respectively and a plurality of data lines to which data signals are inputted, respectively; (b) providing a memory unit storing a single display data indicative of an display content of the picture displaying unit, wherein the memory unit has a plurality of memory cells, and each of the plurality of memory cells stores a unit display data of a part of the single display data; (c) reading a plurality of the unit display data stored in the plurality of memory cells from the memory unit in a different order for each single predetermined frame or each plural predetermined frames; and (d) writing the plurality of unit display data to the picture displaying unit in a order when the plurality of unit display data are read from the memory unit, such that the display content in the picture displaying unit is different for the each predetermined frame or frames.

In this case, the method of driving a picture displaying apparatus further includes: (e) changing a part of the plurality of unit display data before the (c) is performed, and wherein at the (c), the plurality of unit display data including the changed part of the plurality of unit display data are read from the memory unit in the different order for the each predetermined frame or frames, and wherein at the step (d), the plurality of unit display data including the changed part of the plurality of unit display data are written to the picture displaying unit.

In order to achieve yet still another aspect of the present invention, a method of driving a picture displaying apparatus, includes: (f) providing a picture displaying apparatus which includes a picture displaying unit having a plurality of light emission elements, the plurality of light emission elements being disposed at a plurality of intersections composed of a plurality of scanning lines to which scanning signals are inputted, respectively and a plurality of data lines to which data signals are inputted, respectively, wherein the picture displaying unit includes a plurality of pixels corresponding to the plurality of light emission elements; (g) providing a memory unit storing a single display data indicative of an display content of the picture displaying unit, wherein the memory unit has a plurality of memory cells, and each of the plurality of memory cells stores a unit display data of a part of the single display data; (h) reading a plurality of the unit display data from the plurality of memory cells; and (i) writing the read unit display data to each of the plurality of pixels, and wherein at the (i), the plurality of read unit display data are written to the picture displaying unit in a different order for each single predetermined frame or each plural predetermined frames, such that the display content in the picture displaying unit is different for the each predetermined frame or frames.

In this case, the method of driving a picture displaying apparatus further includes: (j) changing a part of the plurality of unit display data before the (h) is performed, and wherein at the step (h), the plurality of unit display data including the changed part of the plurality of unit display data are read from the plurality of memory cells, and wherein at the step (i), the plurality of unit display data including the changed part of the plurality of unit display data are written to the picture displaying unit in the different order for the each predetermined frame or frames.

DESCRIPTION OF THE PREFERRED EMBODIMENTS

As an embodiment of a picture displaying apparatus of the present invention, a picture displaying apparatus applied to a portable telephone will be described below.

First Embodiment

At first, a first embodiment of the picture displaying apparatus of the present invention is described.

Figure 1:
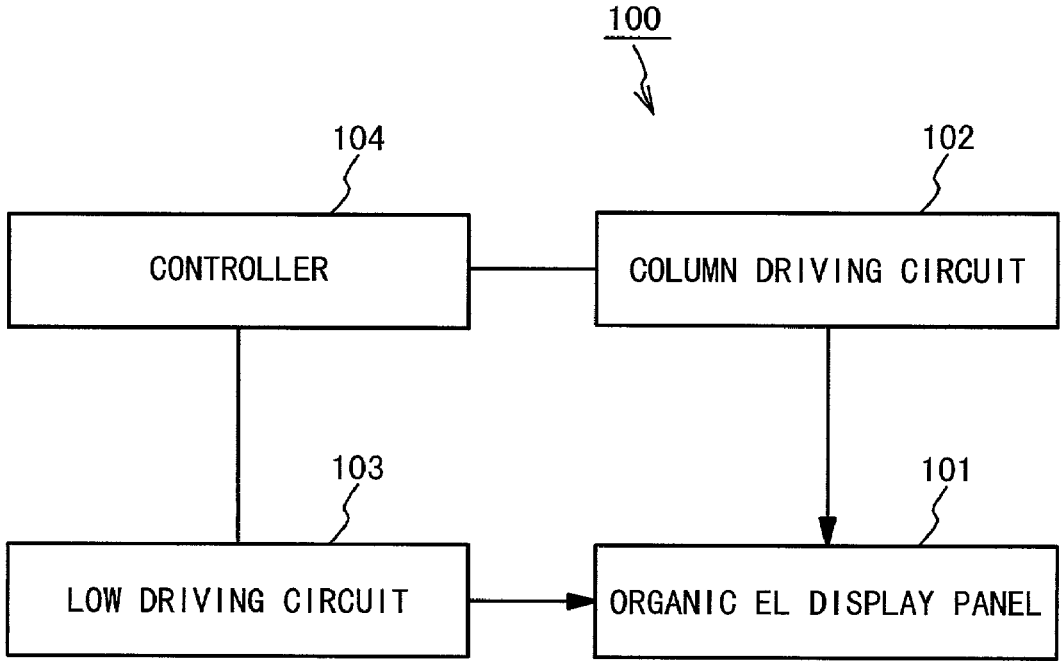
Fig. 1 PRIOR ART
FIG. 1 is a block diagram showing a configuration of a conventional color organic EL display.
Figure 2:
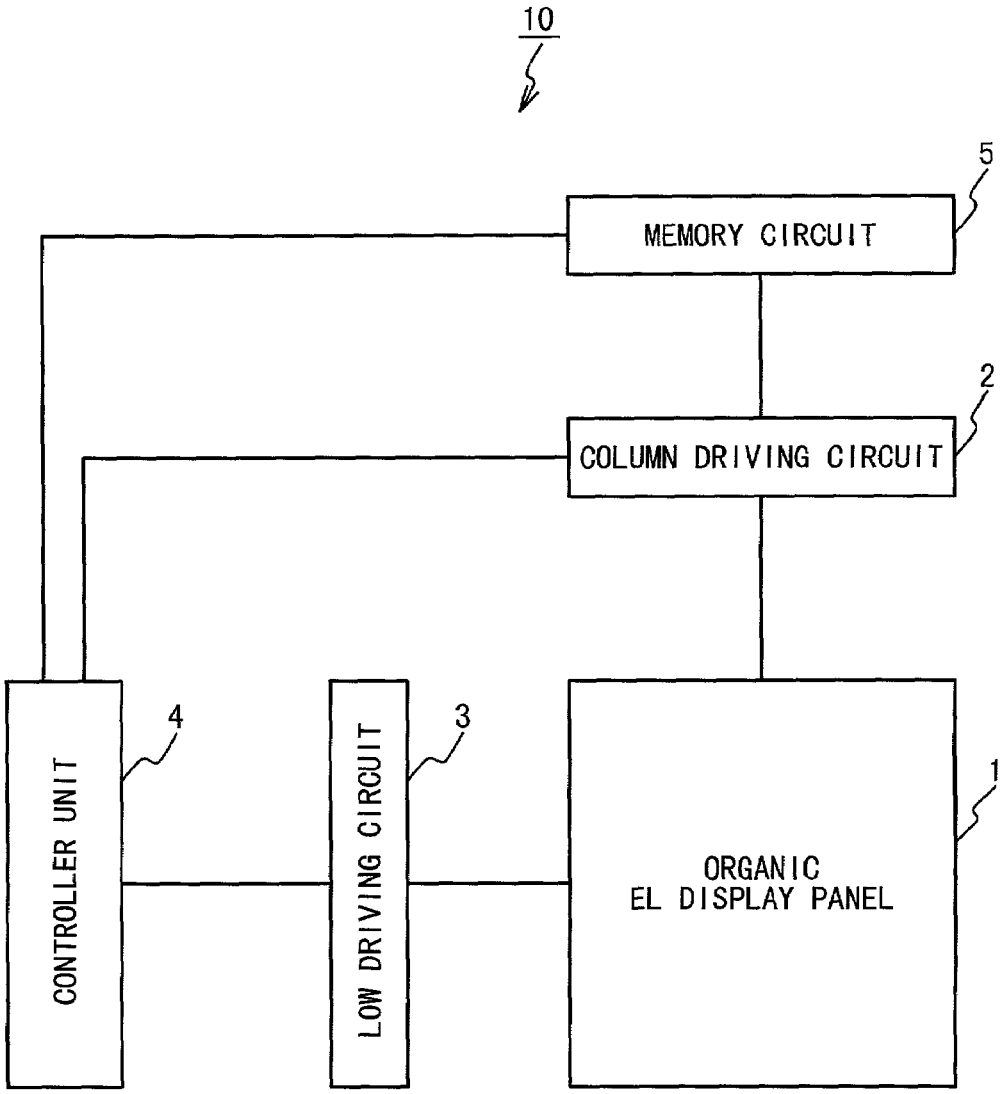
FIG. 2 is a block diagram showing a color organic EL display of a first embodiment of the present invention.

FIG. 2 is a block diagram showing a color organic EL display (picture displaying apparatus) of a QVGA class of a single scan driving method of the first embodiment of the present invention. As shown in FIG. 2, a picture displaying apparatus 10 is provided with an organic EL display panel (picture displaying unit) 1 of a QVGA class using an NTSC signal, a column driving circuit 2 for driving a column side, a low driving circuit 3 for driving a low side, a controller unit 4, and a memory circuit 5 for storing an display data corresponding to one image plane of the organic EL display panel 1.

Figure 3:
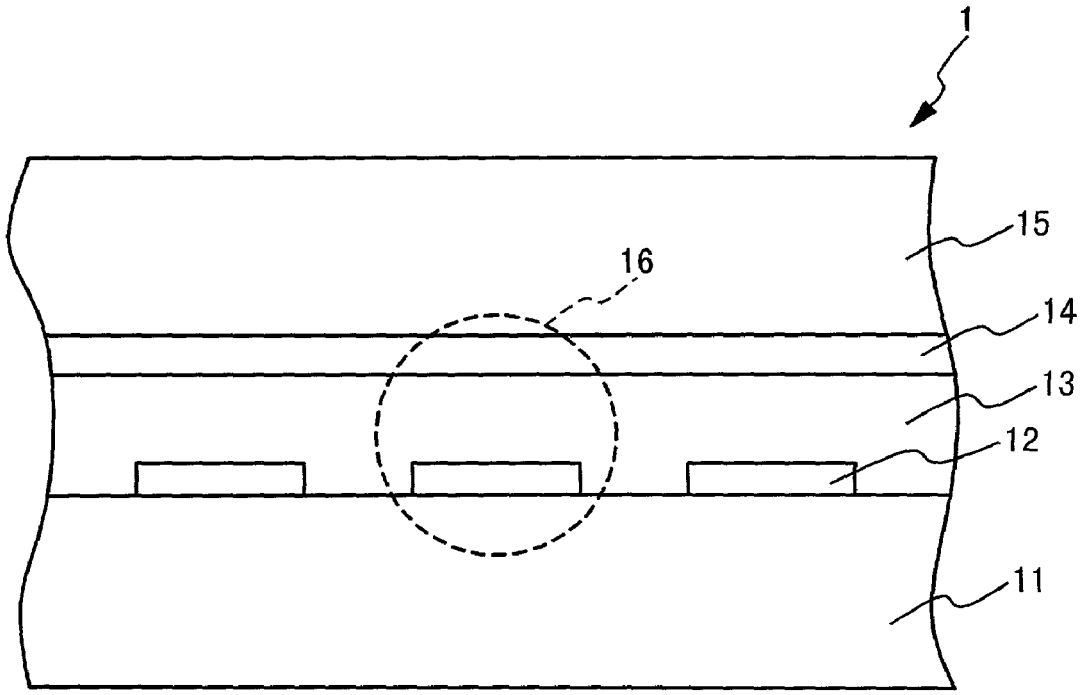
FIG. 3 is a sectional view showing the color organic EL display of the first embodiment of the present invention.

In the organic EL display panel 1, anodes (data electrodes) 12 constituted by striped transparent electrodes, an organic EL thin film (light emitting layer) 13 and a cathode (scanning electrode) 14 constituted by a striped metallic electrode are formed in turn on a transparent substrate 11 such as glass and the like, as shown in FIG. 3. A transparent substrate 15 such as glass and the like is disposed thereon. Then, a matrix structure is created in which the anode 12 and the cathode 14 are orthogonal to each other. And, an organic EL pixel (organic EL element) 16 in a form of matrix is formed at the intersection of the anode (data electrode) 12 and the cathode (scanning electrode) 14.

The column driving circuit 2 drives the column side of the organic EL display panel 1 on the basis of a given control data, and converts into a signal of a predetermined current value on the basis of a given signal voltage level, and then sends a current of a predetermined current density to the organic EL pixel 16 within the organic EL display panel 1, and accordingly displays a picture.

The low driving circuit 3 drives the low side of the organic EL display panel 1 on the basis of a given control data, and displays a picture. The method of driving the low side in this embodiment switches the connection of the electrode of the low side to a power supply side or a ground side or a certain middle potential.

This low driving circuit 3 drives it by using any of: a method of switching the connection of the electrode to the ground side at the time of the drive, and switching the connection of the electrode to the power supply side at the time of the non-drive; a method of switching the connection of the electrode to the power side at the time of the drive, and switching the connection of the electrode to the ground side at the time of the non-drive; a method of switching the connection of the electrode to the ground side at the time of the drive, and switching the connection of the electrode to the certain middle potential at the time of the non-drive; and a method of switching the connection of the electrode to the certain middle potential at the time of the drive, and switching the connection of the electrode to the ground side or the power supply side at the time of the non-drive.

Here, the method of switching the connection of the electrode to the ground side at the time of the drive, and switching the connection of the electrode to the power supply side at the time of the non-drive is applied.

The memory circuit 5 is RAM (Random Access Memory). A first display data corresponding to an display content of one image plane of the organic EL display panel 1 is stored in advance in ROM (not shown) of the color organic EL display 10. The first display data is read from the ROM and written to the memory circuit 5.

The controller unit 4 reads the first display data corresponding to the display content of one image plane of the organic EL display panel 1 written to the memory circuit 5, by using a later-described method, and outputs it to the column driving circuit 2, and then attains the screen saver state in the organic EL display panel 1 without any calculation (change) of the first display data.

Figure 4:
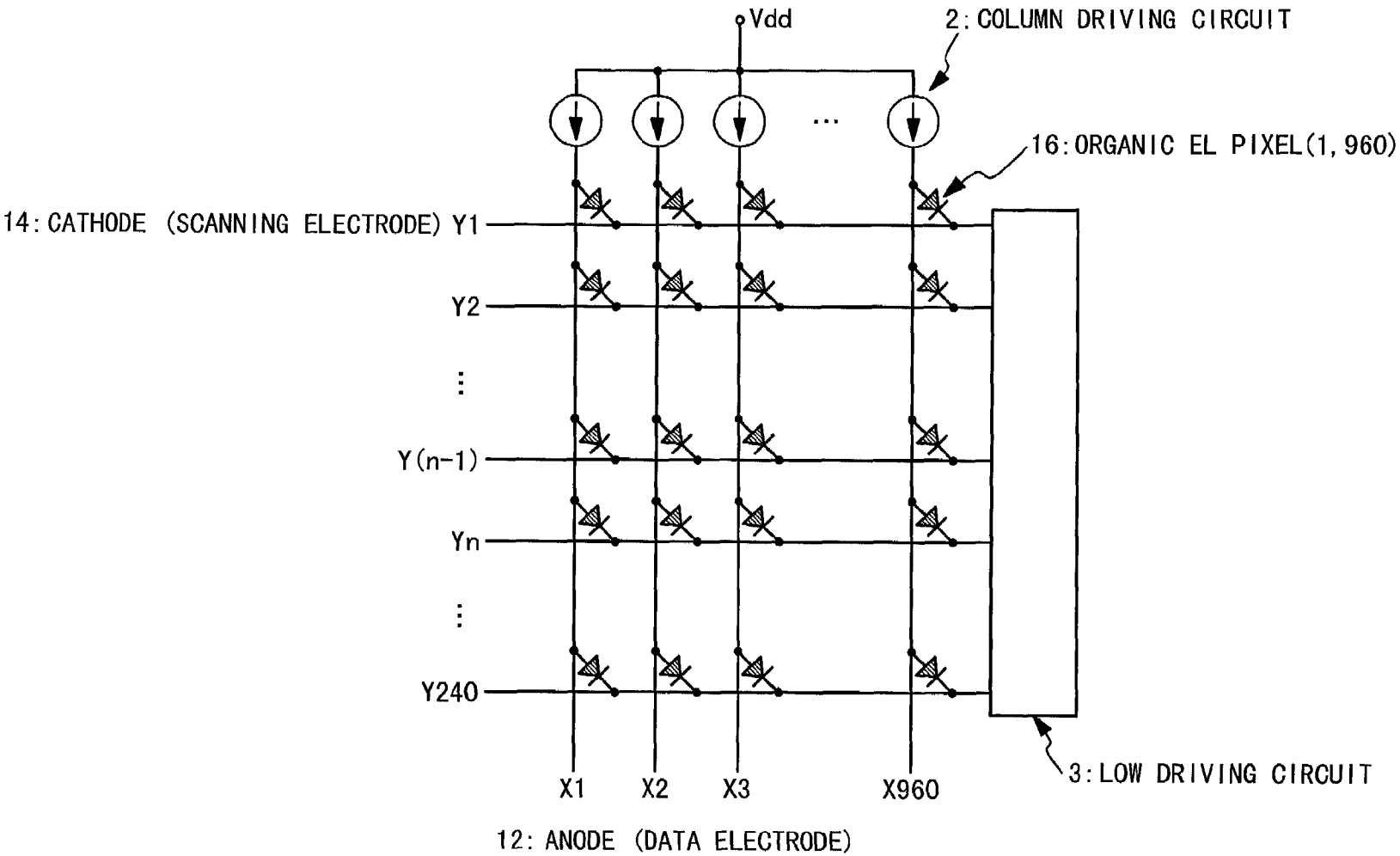
FIG. 4 is a matrix view showing the color organic EL display of the first embodiment of the present invention.

FIG. 4 is a matrix view showing the color organic EL display of the QVGA class in this embodiment. As shown in FIG. 4, with regard to the number of the electrodes of the QVGA class, the number of the cathodes (scanning electrodes) 14 is 240, and the number of the anodes (data electrodes) 12 is 320×3 (RGB)=960. Also, the organic EL pixel 16 is put between the cathode 14 and the anode 12 to accordingly provide the matrix shape. Moreover, the column driving circuit 2 is connected to each anode 12, and the low driving circuit 3 is connected to each cathode 14, respectively.

Figure 5:
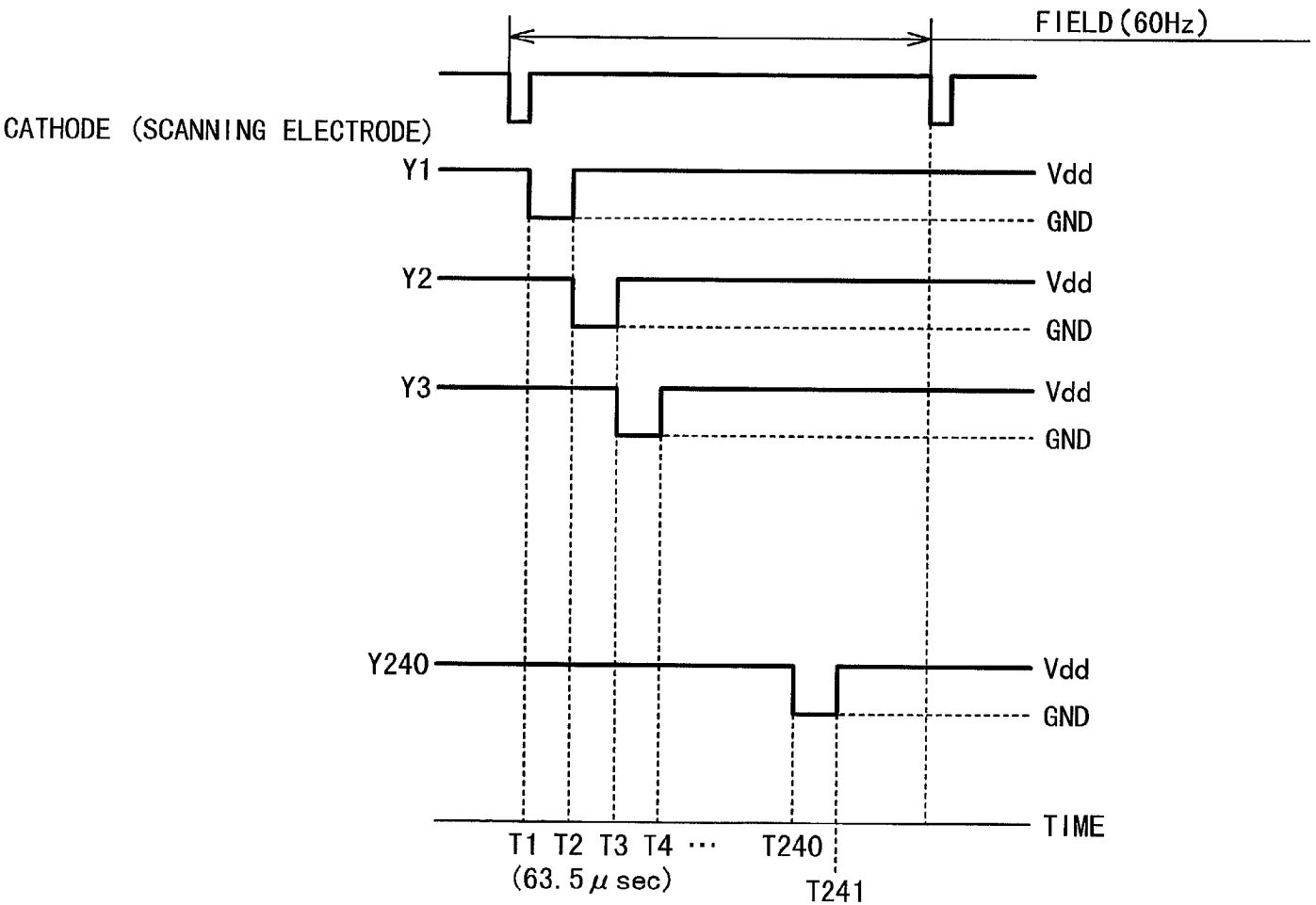
FIG. 5 is a timing chart showing an operation of the color organic EL display of the first embodiment of the present invention.

FIG. 5 is a timing chart showing the operation of the organic EL display panel 1. In FIG. 5, it is driven by a single scan driving method. FIG. 5 shows an example of a matrix in which the number of cathodes (scanning electrodes) is 240 and the number of anodes (data electrodes) is 320×3 (RGB)=960, correspondingly to FIG. 4. In FIG. 5, the NTSC signal is used. The NTSC signal has a vertically synchronous signal of 60 Hz and a horizontally synchronous period of 15.75 kHz (63.5 μs). In the NTSC signal, one field is formed for each two frames.

In this organic EL display panel 1, the low driving circuit 3 drives the cathodes (scanning electrodes) in turn. However, the 240 scanning electrodes Y1 to Y240 are scanned in turn, one by one, to provide one image plane. Thus, a Duty ratio is 1/240. In this driving apparatus, the scanning electrode carrying out the scanning operation is always 1. Hence, this driving method is referred to as the single driving method.

Also, contrastingly to this single scan driving method, there is a driving method referred to as a double scan driving method. This double scan driving method is the driving method in which the number of scanning electrodes on a low side to carry out the simultaneously scanning operation in order to improve a brightness of a display is always 2. For example, in the case of the color organic EL display of the QVGA class, it is halved to an upper portion and a lower portion in a vertical direction at a location corresponding to a position at which the number of horizontally scanning lines is halved. Then, the respective scanning electrodes of the upper and lower portions (respective 120) are driven by one scan so that one image plane is constituted by the upper and lower portions and the Duty ratio is 1/120. By the way, as a known example with regard to this double scan driving method, for example, there is Japanese Laid Open Patent Application (JP-A-Heisei, 61-264876).

This embodiment can employ any of the single scan driving method and the double scan driving method.

The operation of the first embodiment will be described below.

In this embodiment, a position of a start pulse when the display data corresponding to one image plane of the organic EL display panel 1 is read from the memory circuit 5 (the setting of a first memory cell when the data of a memory cell in a form of matrix are read in turn from the memory circuit 5) is controlled on the basis of the control signal from the controller unit 4, and it is freely changed.

The display data corresponding to one image plane of the organic EL display panel 1 is stored in the memory circuit 5 composed of a plurality of memory cells arranged in a form of matrix. When the cell data (one member of the display content corresponding to one image plane of the organic EL display panel 1) are read in turn from the matrix memory cells, the memory cell to be read firstly is not fixed. The control signal from the controller unit 4 is generated in order to change the firstly read memory cell among the plurality of matrix memory cells, for each frame.

The display contents corresponding to one image plane of the organic EL display panel 1 are all displayed on its one frame, irrespectively of the position of the firstly read memory cell.

Figure 6A:
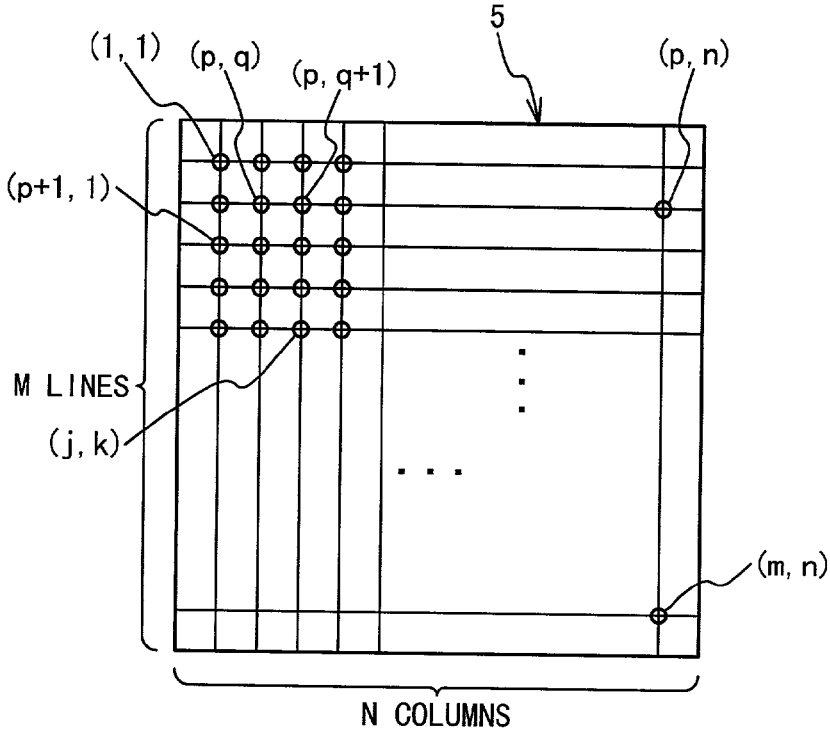
FIG. 6A is a matrix view showing a memory circuit of the first embodiment of the present invention.

As shown in FIG. 6A, the memory circuit 5 has a plurality of (m×n) memory cells formed as a matrix composed of m lines and n columns.

Here, let us suppose that a memory cell at a coordinate position (p, q) of a p-th line and a q-th column is set as a memory cell to be read firstly read, among the plurality of (m×n) memory cells. So, data is read from the memory cell (p, q), and data is read from a memory cell (p, q+1) immediately to the right of the memory cell (p, q), and data is then read from a memory cell (p, q+2) immediately to the right of the memory cell (p, q+1). If they are read from a memory cell (p, n) on the right end of that line in this order, they are read in turn from a memory cell (p+1, 1) on the left end of the next lower line than the previous line to the right side. After that, they are read in this reading order. If they are read from a memory cell (m, n) on the right end of the bottom line, they are then read in turn from a memory cell (1, 1) on the left end of the top line to the right side.

Since the data are finally read from a memory cell (p, q−1) in the above-mentioned order, in one frame, all the display data are read from the matrix memory cells composed of the m lines and the n lines, which correspond to one image plane of the organic EL display panel 1.

The display data read as mentioned above are written to the organic EL display panel 1.

Figure 6B:
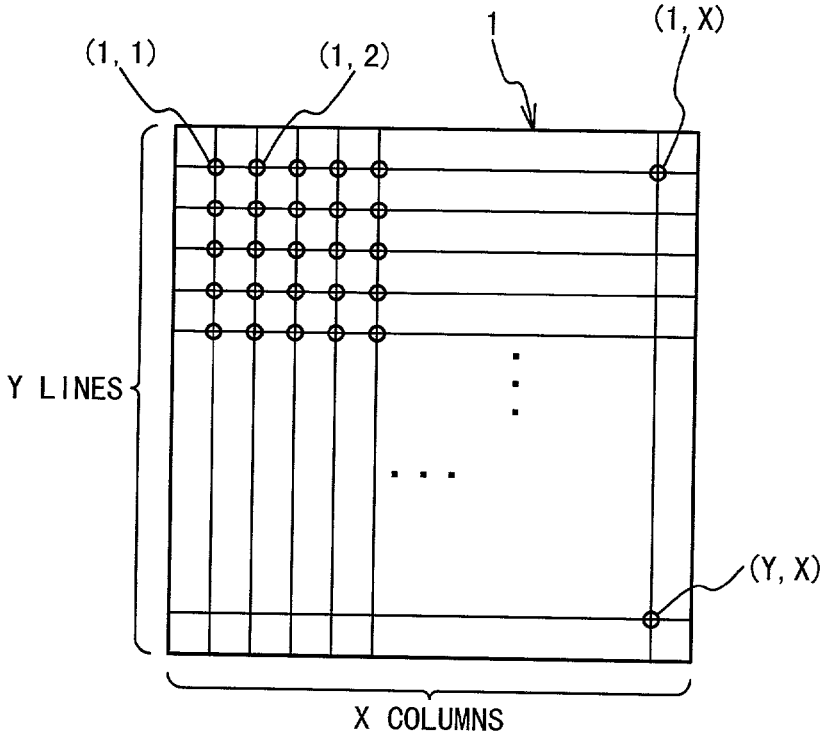
FIG. 6B is a matrix view showing an organic EL display panel of the first embodiment of the present invention.

As shown in FIG. 6B, the organic EL display panel 1 has (Y×X) pixels composed of Y(=m) lines and X(=n) columns.

At this time, the data firstly read from the memory cell (p, q) is written to a pixel (an organic EL pixel) (1, 1) on the left end of the top line. The next data read from the memory cell (p, q+1) is written to a pixel (1, 2) on the right side of the line. If the writing operations are done up to the pixel (1, X) on the right end in this order, the data is written to a pixel (2, 1) on the left end of the next lower line than the previous line. After that, the writing operations are done in this order. Finally, the data read from the memory cell (p, q−1) is written to a pixel (Y, X) on the right end column of the bottom line.

The above-employed method of writing the read data is equal to the conventional method. That is, in this embodiment, the position of the memory cell, from which the reading operation is started, among the matrix memory cells is different from that of the conventional method. The method of writing the read data to the organic EL display panel 1 is equal to that of the conventional method.

According to the above-mentioned method, depending on the position (p, q) of the memory cell to be firstly read, the right portion in the display content corresponding to the normal (original) one image plane is displayed on the left side in the organic EL display panel 1, or the lower portion in the display content corresponding to the normal one image plane is displayed on the upper side in the organic EL display panel 1.

In a first frame, the read operation is started from the memory cell (p, q). Then, in the frame, all the display data are read from the matrix memory cells composed of the m lines and the n columns, which correspond to one image plane of the organic EL display panel 1.

In a next second frame, the reading operation is started from a memory cell (j, k) except the memory cell (p, q) from which the reading operation is started in the first frame. Then, in the frame, all the display data are read from the matrix memory cells composed of the m lines and the n columns, which correspond to one image plane of the organic EL display panel 1. The similar operation is performed on the frames after that.

Figure 7:
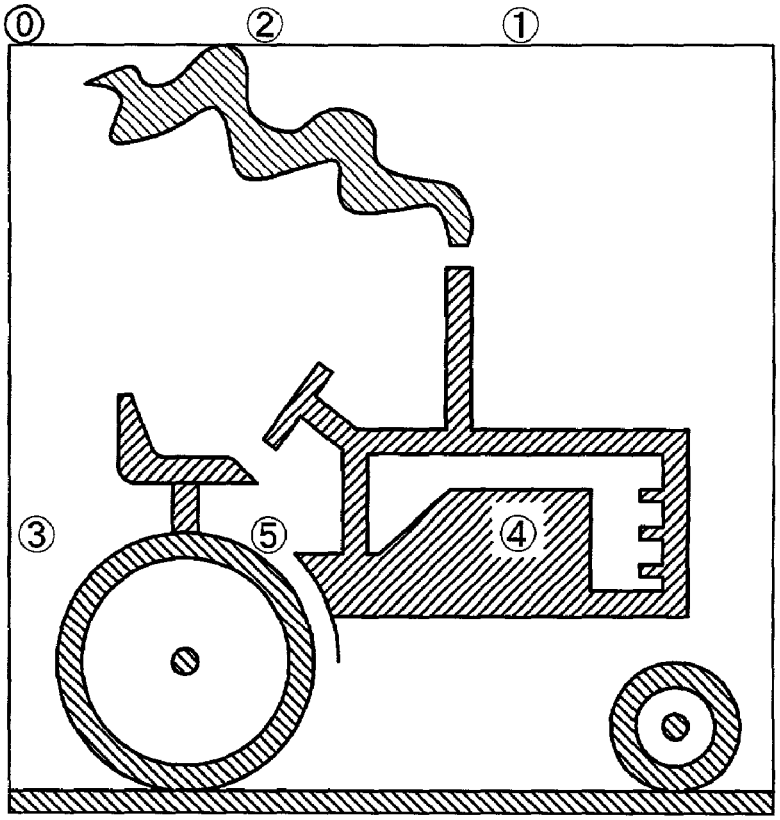
FIG. 7 is a view showing an display data corresponding to one image plane of an organic EL display panel stored in the memory circuit of the first embodiment of the present invention, and showing a start position read for each frame.

FIG. 7 shows the display data corresponding to one image plane of the organic EL display panel 1 stored in the memory circuit 5.

Figure 8A:
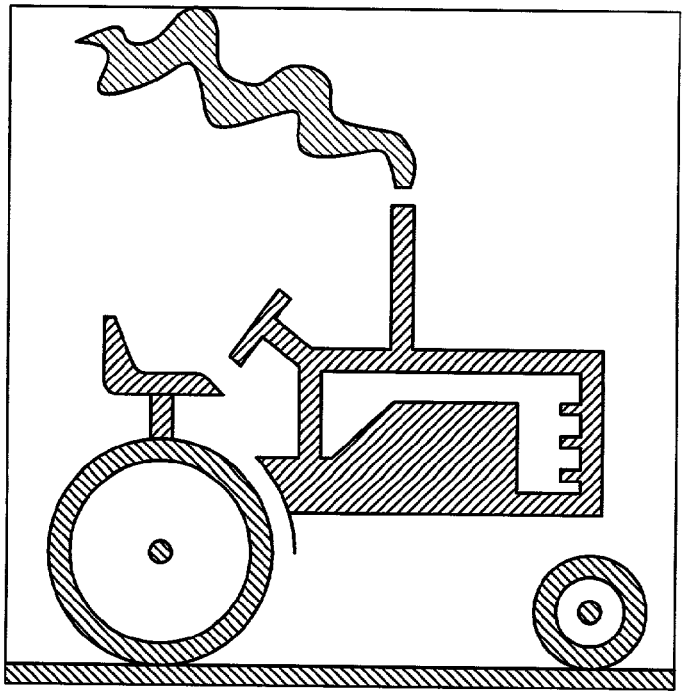
FIG. 8A is a view showing a picture displayed on an organic EL display panel at a first frame, in the first embodiment of the present invention.

In a first frame, the reading operation is started from a memory cell (1, 1) denoted by a symbol (0) of FIG. 7. At this time, a content (normal picture) equal to that written to FIG. 7 is displayed on the organic EL display panel 1, as shown in FIG. 8A.

Figure 8B:
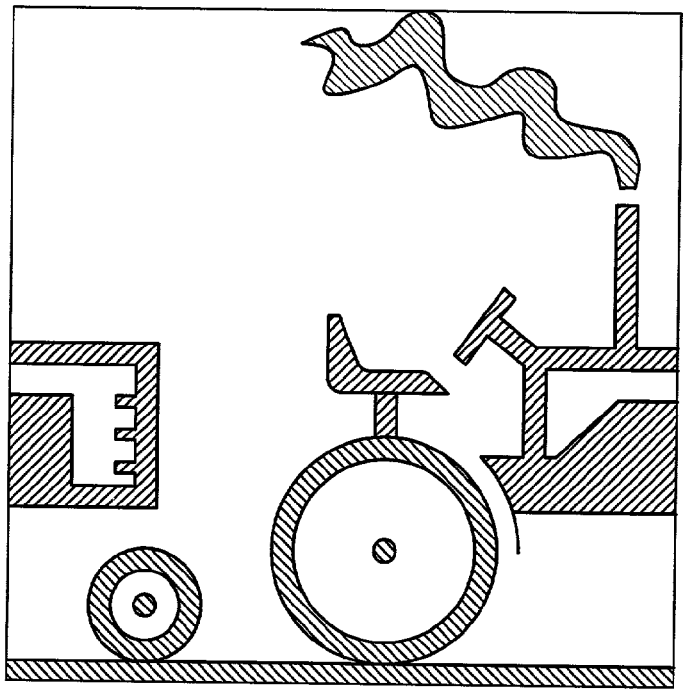
FIG. 8B is a view showing a picture displayed on an organic EL display panel at a second frame, in the first embodiment of the present invention.

In a second frame, the reading operation is started from a memory cell (1, a) denoted by a symbol (1) of FIG. 7. At this time, a content as shown in FIG. 8B is displayed on the organic EL display panel 1.

Figure 9A:
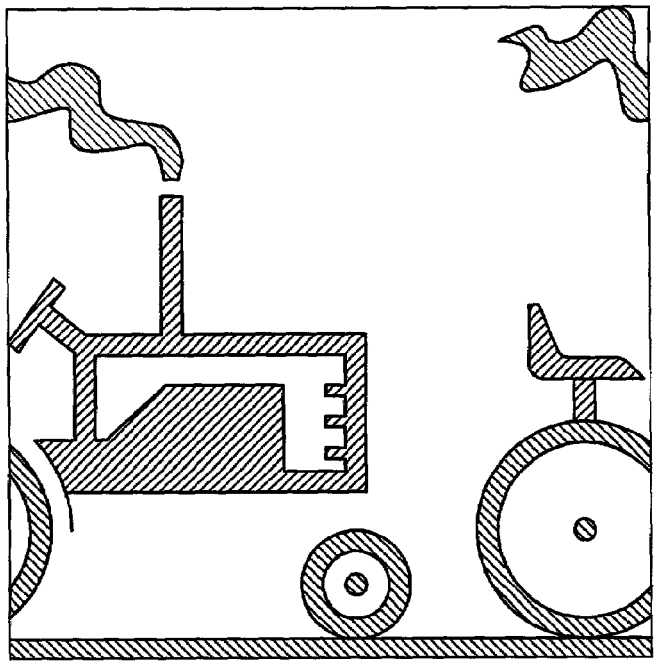
FIG. 9A is a view showing a picture displayed on an organic EL display panel at a third frame, in the first embodiment of the present invention.

In a third frame, the reading operation is started from a memory cell (1, b) denoted by a symbol (2) of FIG. 7. At this time, a content as shown in FIG. 9A is displayed on the organic EL display panel 1.

Figure 9B:
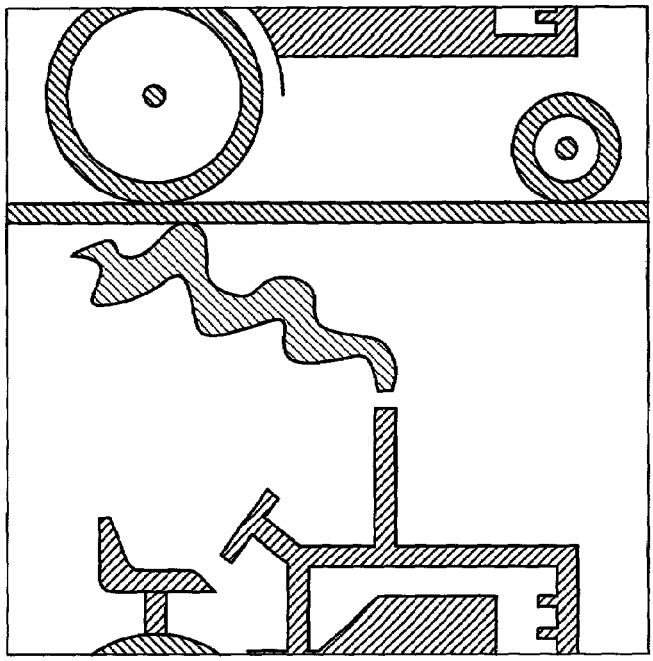
FIG. 9B is a view showing a picture displayed on an organic EL display panel at a fourth frame, in the first embodiment of the present invention.

In a fourth frame, the reading operation is started from a memory cell (c, 1) denoted by a symbol (3) of FIG. 7. At this time, a content as shown in FIG. 9B is displayed on the organic EL display panel 1.

Figure 10A:
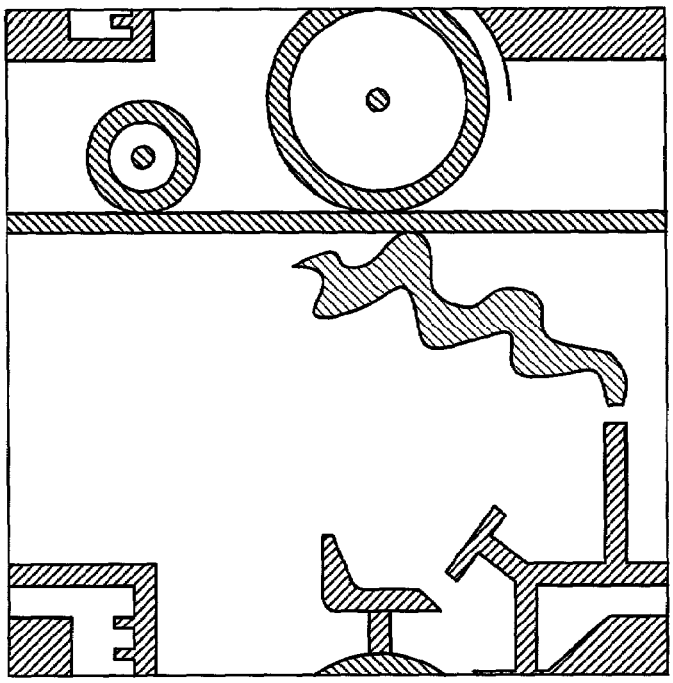
FIG. 10A is a view showing a picture displayed on an organic EL display panel at a fifth frame, in the first embodiment of the present invention.

In a fifth frame, the reading operation is started from a memory cell (c, a) denoted by a symbol (4) of FIG. 7. At this time, a content as shown in FIG. 10A is displayed on the organic EL display panel 1.

Figure 10B:
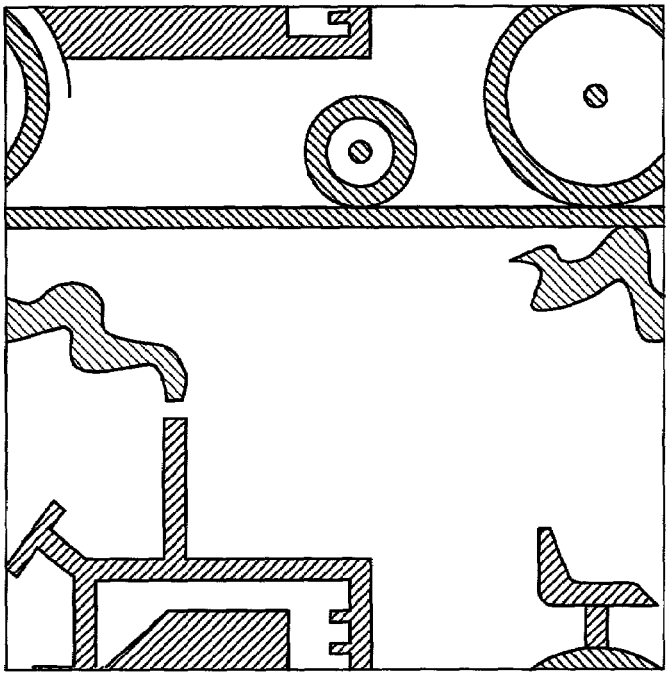
FIG. 10B is a view showing a picture displayed on an organic EL display panel at a sixth frame, in the sixth embodiment of the present invention.
Figure 11A:
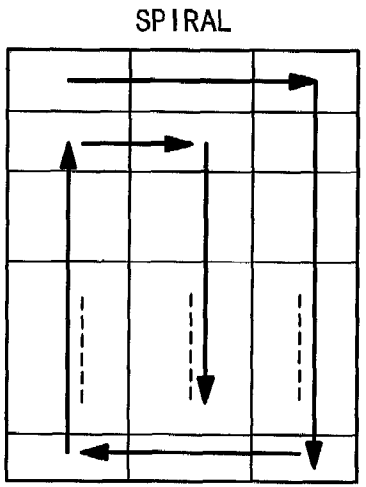
FIG. 11A is a view showing that a read start position changed for each frame is changed in a spiral manner, in the first embodiment of the present invention.
Figure 11B:
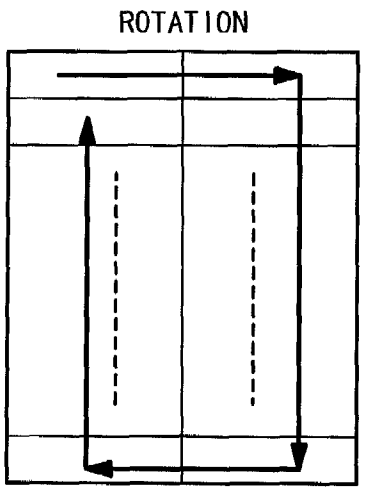
FIG. 11B is a view showing that the read start position changed for each frame is changed in a rotational manner, in the first embodiment of the present invention.
Figure 11C:
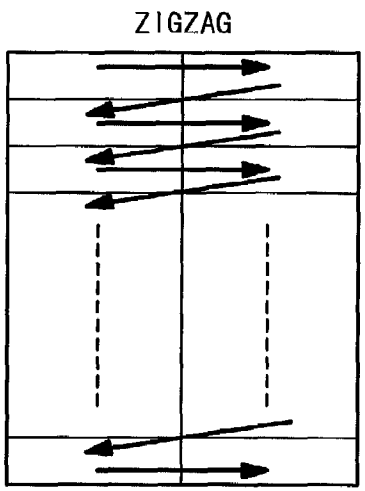
FIG. 11C is a view showing that the read start position changed for each frame is changed in a zigzag manner, in the first embodiment of the present invention.
Figure 11D:
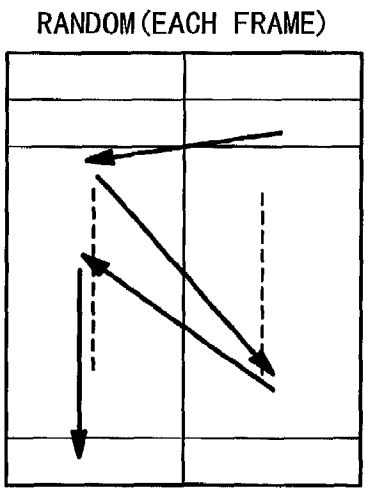
FIG. 11D is a view showing that the read start position changed for each frame is changed in a random manner, in the first embodiment of the present invention.

In a sixth frame, the reading operation is started from a memory cell (c, b) denoted by a symbol (5) of FIG. 7. At this time, a content as shown in FIG. 10B is displayed on the organic EL display panel From the above-mentioned explanations, according to this embodiment, without any additional change to the display data itself corresponding to one image plane of the organic EL display panel 1 stored in the memory cells arranged in the form of the matrix, a different picture for each frame is displayed on the organic EL display panel 1. As a result, it is possible to attain the screen saver state.

When the start positions in the reading operations from the memory cells in the respective frames in the first, second, third to n-th frames are sequentially linked (for example from (0) to (5) of FIG. 7), the respective structures of the spiral, the rotation, the zigzag, the random and the like can be provided as shown in FIGS. 11A to 11D. By the way, in FIGS. 11A to 11D, a tip of each arrow indicates the start position of the reading operation. Also, the structure created by linking the start positions of the reading operations in the respective frames can be selectively changed by a user from the above-mentioned four structures.

If the start position of the reading operation in the first frame is the memory cell (p, q), the start position of the reading operation in the second frame is defined as a memory cell (p, q+1), and the start position of the reading operation in the third frame is defined as a memory cell (p, q+2). That is, it is changed in turn to an adjacent memory cell. At a next frame after the arrival at a memory cell (p, n), the start position of the reading operation is defined as a memory cell (p+1, 1). At a next frame, it is defined in turn as a memory cell (p+1, 2) . . . . So, the pictures are displayed on the actual organic EL display panel 1 as the continuous flow.

Also, at a certain frame among several frames, the normal picture is displayed on the organic EL display panel 1, with the start position of the reading operation as the memory cell (1, 1).

By the way, in the picture displaying apparatus of this embodiment, the screen saver state is released when there is an incoming, or when a call is made, or a ten key button (not shown) of a portable telephone is pushed, or in other cases.

Second Embodiment

A second embodiment of the picture displaying apparatus of the present invention will be described below.

In the second embodiment, the following reading method (second reading method) can be employed instead of the reading method of the first embodiment (first reading method).

Even in the second reading method, the mechanism that all the display data corresponding to one image plane of the organic EL display panel 1 are displayed in the first frame irrespectively of the position of the firstly read memory cell is equal to the first embodiment.

In the second reading method, after the memory cell (p, q) set as the memory cell to be firstly read is read, a memory cell (p, q+2) obtained by skipping to the right over one memory cell from the memory cell (p, q) is read. Then, if the reading operation is done up to the memory cell (p, n) on the right end of the line is read, a memory cell (p+1, 1) on the left end of the next lower line than the previous line is read, and a memory cell (p+1, 1+2) obtained by skipping to the right over one memory cell from the memory cell (p+1, 1) is read. After that, they are read in this order of skipping over one memory cell at a time. Once they are read from the right end of the bottom line, they are read by skipping over one memory cell at a time, from the left end of the top line to the right side.

After that, a memory cell (p, p+1) immediately to the right of the position (p, q) of the memory cell set as the memory cell to be firstly read, namely, the memory cell that was previously skipped over is read. Next, a memory cell (p, q+3) obtained by skipping to the right over one memory cell from the memory cell (p, q+1) is read. Once they are read from the memory cell on the right end of that line is read, they are read by skipping to the right over one memory cell from the left end of the next lower line than the previous line. After that, they are read in this reading order. Once they are read from the right end of the bottom line, they are read by skipping to the right over one memory cell from the left end of the top line.

From the above-mentioned explanations, even in the second reading method, in one frame, all the display data of the matrix memory cells corresponding to one image plane of the organic EL display panel 1 are read.

The method of writing the read data read by this second reading method is equal to the conventionally typical method, similarly to the first reading method.

Third Embodiment

A third embodiment of the picture displaying apparatus according to the present invention will be described below.

Let us suppose that a color picture composed of three colors of R, G and B is displayed on the organic EL display panel 1, on the basis of an display data corresponding to one image plane of the organic EL display panel 1 that is stored in the matrix memory cell of the memory circuit 5.

In the third embodiment, at the time of the screen saver state of the organic EL display panel 1 through the light emitting elements, the control signal from the controller unit 4 is inputted to the column driving circuit 2. Then, the drive currents for the two colors except the light emitting elements of the material having the longest element life among the three colors of R, G and B can be set to zero so that the display is provided at only a single color. For example, the light can be emitted by using only the light emitting element of green.

Accordingly, it is possible to solve the problem of the deterioration in the color balance caused by the characteristic difference between the light emitting elements. By emitting only the green light in which the element life is the longest at the screen saver state, the increase of the deterioration in the brightness of the light emission colors except the green can be suppressed to thereby minimize the deterioration in the color balance. Moreover, the consumptive electric power can be reduced as compared with the three-color light emission.

The column driving circuit 2, when receiving the control signal from the controller unit 4, sets the currents from the current sources corresponding to the pixels of R and B to zero, and stops the supply of the currents. The organic EL pixel 16 can attain the single color light emission by using the above-mentioned method, since the light is not emitted if the current does not flow.

By the way, in the third embodiment, the reading method in the first or second embodiment can be used as the method of reading the memory cell in the memory circuit 5. The conventionally typical method can be used as the method of writing the read data.

Fourth Embodiment

A fourth embodiment of the picture displaying apparatus according to the present invention will be described below.

A fourth reading method used by the fourth embodiment will be described below.

Similarly to the third embodiment, let us suppose that the color picture composed of the three colors of R, G and B is displayed on the organic EL display panel 1, on the basis of the display data corresponding to one image plane of the organic EL display panel 1 that is stored in the matrix memory cell of the memory circuit 5.

In the first frame, only a memory cell corresponding to red is firstly read in turn from a memory cell (p, q) corresponding to, for example, red among the three colors of R, G and B. In the next second frame, only a memory cell corresponding to, for example, green is read. In the next third frame, only a memory cell corresponding to, for example, blue is read.

Fifth Embodiment

A fifth embodiment of the picture displaying apparatus according to the present invention will be described below.

A fifth reading method employed by the fifth embodiment will be described below.

In the fifth reading method, at the first frame, as a preparation stage before a certain memory cell (p, q) is firstly read, a part of an display data corresponding to one image plane of the organic EL display panel 1 stored in m×n matrix memory cells of the memory circuit 5 is set to zero (black). At this time, among the display data corresponding to one image plane of the organic EL display panel 1 stored in the memory circuit 5, an display data corresponding to a periphery of the organic EL display panel 1 can be set to zero, or an display data corresponding to an upper half or a lower half of the organic EL display panel 1 can be set to zero. Moreover, at this time, the memory cell (p, q) to be firstly read can be set to zero.

After the part of the display data stored in the memory circuit 5 is set to zero as mentioned above, the certain memory cell (p, q) is firstly read, at the first frame. In the frame, all the display data of the matrix memory cells composed of the m lines and the n columns, which correspond to one image plane of the organic EL display panel 1, are read (including the display data set to zero at the preparation stage).

At a next second frame, the reading operation is started from a memory cell (j, k) except the memory cell (p, q) from which the reading operation is started at the first frame. In the frame, all the display data of the matrix memory cells composed of the m lines and the n columns, which correspond to one image plane of the organic EL display panel 1, are read (including the display data set to zero at the preparation stage). The similar operations are performed on the frames after that.

In the fifth embodiment, any of the first to fourth embodiments can be carried out after the execution of the preparation stage (the deletion of the part of the display data corresponding to one image plane).

The first to fifth embodiments are described such that the picture data corresponding to one image plane of the organic EL display panel 1 stored in the matrix memory cells of the memory circuit 5 is the static picture data. That is, in the first to fifth embodiments, the reading method is described in which the start positions when the plurality of memory cell data constituting the single static picture are read are different for the respective frames.

Instead of it, the picture data corresponding to one image plane of the organic EL display panel 1 stored in the matrix memory cells of the memory circuit 5 may be the dynamic picture data. Originally, a different picture for each frame may be used in the memory circuit 5 as the dynamic picture data, and the start positions when a plurality of different pictures for each frame are read may be changed for each frame.

Sixth Embodiment

A sixth embodiment of the picture displaying apparatus according to the present invention will be described below.

In the first to fifth embodiments, when the picture data corresponding to one image plane of the organic EL display panel 1 stored in the matrix memory cells of the memory circuit 5 is read, by changing the position of the memory cell from which the reading operation is started for each frame, namely, by thinking out the reading method, the screen saver function can be attained without any change of the method of writing the read data to the respective pixels of the organic EL display panel 1 from the conventional method.

In the sixth embodiment, the screen saver function is attained by thinking out the method of writing the read data to the respective pixels of the organic EL display panel 1 without any change of the reading method from the conventional method. This method will be described below.

In the display data corresponding to one image plane of the organic EL display panel 1 stored in the matrix memory cells composed of the m lines and the n columns, similarly to the conventional method, the reading operation is always (in any frame) started from a memory cell of a coordinate (1, 1). Next, they are read in an order of (1, 2), (1, 3) . . . (1, n), (2, 1), (2, 2), (2, 3) . . . (2, n), (3, 1), (3, 2), (3, 3) . . . (3, n) . . . (m, n).

With regard to the read data, the writing operation is started from a different pixel for each frame, in the organic EL display panel 1. Irrespectively of a position of a firstly written pixel, in the one frame, all the read data corresponding to one image plane of the organic EL display panel 1 are written to the organic EL display panel 1, and they are displayed.

This will be actually described below.

In the first frame, a data read from the memory cell of the coordinate (1, 1) is written to a pixel (v, w) at a v-th line and a w-th column in (Y×X) pixels of the organic EL display panel 1 composed of Y lines and X columns. Next, a data read from a memory cell of a coordinate (1, 2) is written to a pixel (v, w+1), and a data read from a memory cell (1, 3) is written to a pixel (v, w+2). After that, they are written in this write order (from the left to the right and from the upper portion to the lower portion). Finally, a data read from a memory cell of a coordinate (m, n) is written to a pixel (v, w−1).

In the second frame, the writing operation is started from an operation for writing the data read from the memory cell of the coordinate (1, 1) to a pixel (α, β) except the pixel (v, w). Finally, the data read from the memory cell of the coordinate (m, n) is written to a pixel (α, β−1). The similar operation is performed on the frames after that.

The respective embodiments of the picture displaying apparatus according to the present invention and the method of driving the same have been described as mentioned above. However, the actual configuration is not limited to the embodiments. The change in the design and the like can be done without departing from the spirit and the scope of the present invention.

For example, in the respective embodiments, the organic EL element is used as the light emitting element. However, an inorganic EL element, a light emitting diode, FED and the like may be used.

Also, the usage picture signal is not limited to the NTSC signal. It may be a PAL signal, an HDTV signal, a VGA signal, a digital signal or the like.

As mentioned above, according to the respective embodiments, the different picture for each frame is displayed on the actual organic EL display panel 1, without any change to the display data itself corresponding to one image plane of the organic EL display panel 1 stored in the memory cells arranged in the form of the matrix. As a result, it is possible to attain the screen saver function.

Also, the respective embodiments are designed such that the reading operation is done at the reading start position different for each frame, and the writing operation is done at the writing start position different for each frame, and the different picture for each frame is displayed on the organic EL display panel 1. Instead of this design, the respective embodiments can be designed such that the reading operation is done at a reading start position different for each of a plurality of set frames, and the writing operation is done at a writing start position different for each of the plurality of set frames, and the different picture for each of the plurality of set frames is displayed on the organic EL display panel 1.

This case does not require the calculating circuit for generating a plurality of second display data corresponding to a plurality of display content at the time of the screen saver, differently from the conventional technique.

Also, it is possible to suppress the deterioration in the color balance caused by the characteristic difference between the light emitting elements.

The picture displaying apparatus of the present invention is provided with: a scanning electrode usually serving as a cathode; a data electrode usually serving as an anode (transparent electrode); a display composed of light emitting elements put between the scanning electrode and the data electrode, in which the scanning electrode and the data electrode are arranged so as to cross each other; a memory circuit having an display data corresponding to one image plane of the display; a column driving unit for sending a signal current to make the display emit a light at a desirable brightness; a low driving unit for grounding electrodes on a low side while shifting them in turn, in order to perform a Duty drive on the display; and a controller unit for generating a control signal to control the column driving unit and the low driving unit.

In a controlling method of the present invention, at a time of a screen saver state of a full color display using a light emitting element, a control signal from the controller unit is sent to the column driving unit. Then, drive currents for two colors except a light emitting element of a material having the longest element life among the three colors of R, G and B are set to 0 to accordingly define the display of only single color.

Also, at this time, a position of a start pulse when an display data corresponding to one image plane of the display is read from a memory circuit is controlled on the basis of the control signal from the controller unit, and it is arbitrarily changed.

For example, at the time of the screen saver state, the light is emitted only from the light emitting element having the longest element life, for example, the light emitting element of the material of green.

Also, at this time, by defining the position of the start pulse from the memory circuit as a regular zigzag or random manner, or moving it in a rotational or spiral manner, the display on the display can be defined as a zigzag, random, rotational or spiral manner.

At this time, the entire data corresponding to one image plane can be displayed by displaying the data protruding from a right end or a lower end of a displayable range, immediately in turn from a left end or an upper end.

Or, the similar control can be done by switching between the data of the entire image plane and the data of the partial range of the entire image plane by using the control signal from the controller unit.

According to the control method of the present invention, the lower electrical power consumption can be attained by using the single color display, as compared with the usual display using the three colors of R, G and B. It can be achieved by carrying out the display only through the light emitting element of the material having the longest element life, in the displaying method at the screen saver state of the full color display using the light emitting element. At this time, the light emission at the green single color having the longest element life enables the variation in the color balance to be reduced at the time of the simultaneous light emission of R, G and B.

As the displaying method of the present invention, the life deterioration of a part of pixels can be protected by avoiding a fixed patter and always moving an display picture on the display. At this time, without any change of the display data within the memory of the display, the position of the start pulse when the data is read from the memory can be arbitrarily defined such as a random, zigzag, spiral or rotational manner.

In particular, the attainment of the lower consumptive electric power based on a screen saver of partial illumination is not effective in a liquid crystal display requiring a back light, and it is a device unique to a display in which an display is carried out by using a light emitting element of a self-light-emission-type.

The present invention relates to an information display panel through a light emitting element, a measuring instrument panel, a displaying apparatus of a display for displaying a dynamic picture and a static picture, and a method of controlling the same. More particular, at the time of the screen saver state, the display is done only by using the light emitting element of the material having the longest element life. Also, the display data within the memory of the display is not changed. Moreover, the position of the start pulse when the data is read from the memory is freely defined such as the random, zigzag, spiral or rotational manner.

In the present invention, at the time of the screen saver state of the full color display through the light emitting element, the control signal from the controller unit is inputted to the column driving unit, and the drive current for the two colors except the light emitting element of the material having the longest element life is set to zero to thereby provide the display of only the single color. For example, the light is emitted only by using the green light emitting element having the longest element life.

As mentioned above, according to the picture displaying apparatus of the present invention, the conventional calculating circuit is not required when the screen saver function is attained.

What is claimed is:

1. A picture displaying apparatus, comprising:

a picture displaying unit; and a memory unit storing a single display data indicative of a display content of said picture displaying unit, and wherein said memory unit has a plurality of memory cells, and wherein each of said plurality of memory cells stores a unit display data of a part of said single display data, and wherein a plurality of said unit display data stored in said plurality of memory cells are read from said memory unit in a first order and said plurality of the unit display data are read from said memory unit in at least one second order, and wherein said plurality of unit display data read in said first order are written to said picture displaying unit as a first predetermined frame and the plurality of unit display data read in said at least one second order are written to said picture displaying unit as at least one second predetermined frame, said first predetermined frame and said at least one second predetermined frame are displayed as different images by writing said plurality of unit display data to the picture displaying unit in said first order and said at least one second order.

2. The picture displaying apparatus according to claim 1, wherein when said plurality of unit display data are read from said memory unit, at least one specific memory cell among said plurality of memory cells is used as a read start position and said plurality of unit display data are read in accordance with an arrangement order of said plurality of memory cells from said specific memory cell, and wherein, said specific memory cell is changed for said first predetermined frame and said at least one second predetermined frame.

3. The picture displaying apparatus according to claim 1, wherein a part of said plurality of unit display data is changed before said part of said plurality of unit display data is read from said memory unit in said first order and said at least one second order, and wherein said plurality of unit display data including said changed part of said plurality of unit display data are read from said memory unit in said first order and said at least one second order, and wherein said plurality of unit display data including said changed part of said plurality of unit display data read from said memory unit in said first order are written to said picture displaying unit in accordance with said first order as said first predetermined frame and said plurality of unit display data including said changed part of said plurality of unit display data read from said memory unit in said at least one second order are written to said picture displaying unit in accordance with said at least one second order as said at least one second predetermined frame.

4. The picture displaying apparatus according to claim 2, wherein a part of said plurality of unit display data is changed before said part of said plurality of unit display data is read from said memory unit in said first order and said at least one second order, and wherein said plurality of unit display data including said changed part of said plurality of unit display data are read from said memory unit in said first order and said at least one second order, and wherein said plurality of unit display data including said changed part of said plurality of unit display data read from said memory unit in said first order and written to said picture displaying unit in accordance with said first order as said first predetermined frame and said plurality of unit display data including said changed part of said plurality of unit display data read from said memory unit in said at least one second order are written to said picture displaying unit in accordance with said at least one second order as said at least one second predetermined frame.

5. A picture displaying apparatus, comprising:

a picture displaying unit having said plurality of light emission elements; and a memory unit storing a single display data indicative of a display content of said picture displaying unit, and wherein said memory unit has a plurality of memory cells, and wherein said picture displaying unit has a plurality of pixels corresponding to said plurality of light emission elements, and wherein each of said plurality of memory cells stores a unit display data of a part of said single display data, and wherein said unit display data is written to each of said plurality of pixels, and wherein a plurality of said unit display data are read from said plurality of memory cells in a first order are written to said picture displaying unit as a first predetermined frame and said plurality of said unit display data are read from said plurality of memory cells in at least one second order and written to said picture displaying unit as at least one second predetermined frame, said first predetermined frame and said at least one second predetermined frame are displayed as different images by writing the unit display data to the picture displaying unit in said first order and said at least one second order.

6. The picture displaying apparatus according to claim 5, wherein, when said plurality of unit display data are written to said picture displaying unit, at least one specific pixel among said plurality of pixels is used as a write start position and said plurality of unit display data are written in accordance with an arrangement order of said plurality of pixels from said specific pixel, and wherein said specific pixel is changed for said first predetermined frame and for said at least one second predetermined frame.

7. The picture displaying apparatus according to claim 5, wherein a part of said plurality of unit display data is changed before said part of said plurality of unit display data is read from said memory unit, and wherein said plurality of unit display data including said changed part of said plurality of unit display data are written to said picture displaying unit in a different order for said first predetermined frame and for said at least one second predetermined frame.

8. The picture displaying apparatus according to claim 6, wherein a part of said plurality of unit display data is changed before said part of said plurality of unit display data is read from said memory unit, and wherein said plurality of unit display data including said changed part of said plurality of unit display data are written to said picture displaying unit in a different order for said first predetermined frame and for said at least one second predetermined frame.

9. The picture displaying apparatus according to claim 1, further comprising a plurality of data lines to which data signals are inputted, wherein said picture displaying unit is designed such that lights of said picture displaying unit can be emitted in three colors of R, G and B, and wherein a supply of currents to said plurality of data lines corresponding to at least one of said three colors of R, G and B is stopped, such that said lights are emitted from said picture displaying unit in one or two colors among said three colors of R, G and B.

10. The picture displaying apparatus according to claim 5, further comprising a plurality of data lines to which data signals are inputted, wherein said picture displaying unit is designed such that lights of said picture displaying unit can be emitted in three colors of R, G and B, and wherein a supply of currents to said plurality of data lines corresponding to at least one of said three colors of R, G and B is stopped, such that said lights are emitted from said picture displaying unit in one or two colors among said three colors of R, G and B.

11. The picture displaying apparatus according to claim 9, wherein said at least one of said three colors of R, G and B is changed for said first predetermined frame and for said at least one second predetermined frame.

12. The picture displaying apparatus according to claim 10, wherein said at least one of said three colors of R, G and B is changed for said first predetermined frame and for said at least one second predetermined frame.

13. The picture displaying apparatus according to claim 1, wherein said single display data is one of static picture data and dynamic picture data.

14. The picture displaying apparatus according to claim 5, wherein said single display data is one of static picture data and dynamic picture data.

15. The picture displaying apparatus according to claim 1, wherein picture displaying unit comprises a plurality of light emission elements, wherein said plurality of light emission elements are one of EL elements, light emitting diodes and FEDs.

16. The picture displaying apparatus according to claim 5, wherein said plurality of light emission elements are one of EL elements, light emitting diodes and FEDs.

17. A method of driving a picture displaying apparatus, comprising:

(a) providing a picture displaying apparatus which includes a picture displaying unit;

(b) providing a memory unit storing a single display data indicative of a display content of said picture displaying unit, wherein said memory unit has a plurality of memory cells, and each of said plurality of memory cells stores a unit display data of a part of said single display data;

(c) reading a plurality of said unit display data stored in said plurality of memory cells from said memory unit in a first order and said plurality of said unit display data are read from said memory unit in at least one second order; and (d) writing said plurality of unit display data to said picture displaying unit in said first order as a first predetermined frame when said plurality of unit display data are read from said memory unit in said first order and writing said plurality of unit display data to said picture displaying unit in said at least one second order as at least one second predetermined frame when said plurality of unit display data are read from said memory unit in said at least one second order, said first predetermined frame and said at least one second predetermined frame are displayed as different images by writing said plurality of unit display data to the picture displaying unit in said first order and said at least one second order.

18. The method of driving a picture displaying apparatus according to claim 17, further comprising:

(e) changing a part of said plurality of unit display data before said (c) is performed, and wherein at said (c), said plurality of unit display data including said changed part of said plurality of unit display data are read from said memory unit in said first order and said at least one second order, and wherein at said step (d), said plurality of unit display data including said changed part of said plurality of unit display data are written to said picture displaying unit.

19. A method of driving a picture displaying apparatus, comprising:

(f) providing a picture displaying apparatus which includes a picture displaying unit having a plurality of light emission elements, wherein said picture displaying unit includes a plurality of pixels corresponding to said plurality of light emission elements;

(g) providing a memory unit storing a single display data indicative of an display content of said picture displaying unit, wherein said memory unit has a plurality of memory cells, and each of said plurality of memory cells stores a unit display data of a part of said single display data;

(h) reading a plurality of said unit display data from said plurality of memory cells in a first order and at least one second order; and (i) writing said read unit display data to each of said plurality of pixels, and wherein at said (i), said plurality of read unit display data are written to said picture displaying unit in said first order as a first predetermined frame and said plurality of read unit display data are written to said picture displaying unit in said at least one second order as at least one second predetermined frame, said first predetermined frame and said at least one second predetermined frame are displayed as different images by writing the unit display data to the picture displaying unit in said first order and said at least one second order.

20. The method of driving a picture displaying apparatus according to claim 19, further comprising:

(j) changing a part of said plurality of unit display data before said (h) is performed, and wherein at said step (h), said plurality of unit display data including said changed part of said plurality of unit display data are read from said plurality of memory cells, and wherein at said step (i), said plurality of unit display data including said changed part of said plurality of unit display data are written to said picture displaying unit as said first predetermined frame and at least one second predetermined frame.

* * * * *